US006196962B1

(12) United States Patent
Purvey et al.

(10) Patent No.: US 6,196,962 B1
(45) Date of Patent: Mar. 6, 2001

(54) CENTRIFUGAL SEPARATOR WITH VORTEX DISRUPTION VANES

(75) Inventors: Ronald J Purvey, Axminster; Ian M Cox, Yeovil, both of (GB)

(73) Assignee: Federal-Mogul Engineering Limited (GB)

( * ) Notice: Subject to any disclaimer, the term of this patent is extended or adjusted under 35 U.S.C. 154(b) by 0 days.

(21) Appl. No.: 09/254,317

(22) PCT Filed: Aug. 21, 1997

(86) PCT No.: PCT/GB97/02248

§ 371 Date: Mar. 4, 1999

§ 102(e) Date: Mar. 4, 1999

(87) PCT Pub. No.: WO98/11994

PCT Pub. Date: Mar. 26, 1998

(30) Foreign Application Priority Data

Sep. 17, 1996 (GB) ..... 9619366

(51) Int. Cl.[7] ..... B04B 7/04; B04B 9/06

(52) U.S. Cl. ..... 494/49; 494/60

(58) Field of Search ..... 494/24, 36, 49, 494/60, 64, 65, 67, 43, 84, 901; 210/168, 171, 232, 360.1, 380.1, 416.5; 184/6.24

(56) References Cited

U.S. PATENT DOCUMENTS

| | | | | |
|---|---|---|---|---|
| 4,165,032 | * | 8/1979 | Klingenberg . | |
| 4,284,504 | | 8/1981 | Alexander et al. . | |
| 4,400,167 | * | 8/1983 | Beazley et al. | 494/49 |

FOREIGN PATENT DOCUMENTS

| | | |
|---|---|---|
| 2 049 494 | 12/1980 | (GB) . |
| 2 120 134 | 11/1983 | (GB) . |
| 2 282 087 | 3/1995 | (GB) . |
| WO 80 01764 | 9/1980 | (WO) . |

* cited by examiner

*Primary Examiner*—Charles E. Cooley
(74) *Attorney, Agent, or Firm*—Nixon & Vanderhye P.C.

(57) ABSTRACT

A centrifugal separator for removing particulate contaminants from liquid such as engine lubricants consists of a housing for securing to the engine having a funnel-shaped floor from which oil can drain centrally at a drainage duct. The housing is secured to a legged spider or cage carrying a hollow axle by which the apparatus is secured to the engine and oil delivered to a separation rotor canister. Liquid ejected tangentially from rotor nozzles to cause it to rotate tends to flow around the inside of the housing as a vortex and to prevent rotation of the canister being interfered with by climbing of the vortex or splashing of the liquid from such vortex, one or more vortex disruption vanes are formed with the legs of the cage to deflect liquid.

14 Claims, 2 Drawing Sheets

CENTRIFUGAL SEPARATOR WITH VORTEX DISRUPTION VANES

TECHNICAL FIELD

This invention relates to centrifugal separation apparatus for separating particulate contaminants from liquids, such as engine lubricants, passed therethrough, and in particular relates to the efficient drainage of low viscosity liquids from such apparatus.

BACKGROUND

Centrifugal separators are well known for use within the lubrication systems of vehicle internal combustion engines as efficient means for removing very small particulate contaminants from the constantly recirculated liquid lubricant over a long period of operation. Such centrifugal separators are usually of the self-powered type, in which a separation rotor comprising a canister is supported for rotation about a rotor axis within a housing, the canister being supplied with liquid lubricant at elevated pressure along the axis and said liquid being forced from the base of the canister (or other peripheral wall) by way of substantially tangentially-directed jet reaction nozzles, the reaction to said ejection causing the rotor canister to spin at high speed about the axis and thereby cause solid particles to migrate from the liquid passing through the canister and agglomerate on the peripheral walls thereof. The jet or reaction nozzles are directed substantially tangentially with respect to the rotation axis, at least in a plane orthogonal to the axis, so that jets of liquid which leave the rotor canister are instantaneously tangential to the fast spinning rotor.

It will be appreciated that the efficiency of separation is dependant upon the rotation speed of the rotor canister and also the quantity of lubricant passed therethrough in a given time, that is in turn, dependant upon the pressure drop between supply (canister) and housing and the dimensions of the nozzles, and within the constraints of such nozzle dimensions/pressure drops providing sufficient torque to overcome resistance to commencement of, and continuation of, rotation. Therefore, efficient rotation is dependent upon maintaining a good pressure drop across the reaction nozzles, that is, with the atmosphere inside the housing at ambient atmospheric pressure, so that it is necessary to drain this ejected liquid from the housing by gravity. In particular, it is necessary for the liquid to drain from the housing at a rate exceeding that of its supply to the rotor canister so that the ejected liquid does not accumulate in the housing and rise to a level at which it contacts, and stalls, the rotor. Such a gravity drainage system is frequently provided by means of a drainage duct, opening to the floor of the housing, of such cross-sectional area that not only can the liquid drain at a rate in excess of its supply to the rotor, but also can simultaneously permit venting of the housing to facilitate the drainage.

It will also be appreciated that the rotor canister may also be impeded in rotation by droplets of lubricant emitted by the nozzles that splash from the surfaces within the housing.

In practice there is almost invariably a requirement for overall minimal dimensions consistent with achieving a desired degree of functional efficiency, which requirement is met by having the housing dimensions only marginally exceeding the rotor, and the housing side wall usually conforms to the cylindrical locus of the volume swept by the rotating rotor, that is, is circular in cross-section that defines said minimal clearance. It will be appreciated that each tangentially directed and rotating reaction jet tends to strike the wall at a glancing angle. Whilst this reduces the tendency to splash and impede rotation to some extent, but not completely (and for which reason the axes of the reaction nozzles may be declined towards the floor of the housing), the lubricant is incident on the wall and/or floor at such angle as to cause this liquid to circulate around the housing as it falls towards the floor thereof and the drain.

It has been found that in some designs the effect of the circulating liquid in conjunction with a rapidly circulating atmosphere due to the rotor creates a vortex effect whereby the liquid accumulates in a vortex circulating about the periphery of the housing rather than flowing efficiently into the duct, notwithstanding the cross-sectional area of the drainage duct, and the level of this spent liquid gradually rises until the liquid touches the rotor and causes it to stall. The effect of such stalling is to permit the liquid to cease circulating at speed and begin to drain property, whereupon the rotor can recommence spinning until circumstances again force it to stall. Therefore, it is difficult to know when, and for what percentage of the time, the rotor is actually spinning and performing useful centrifugal separation.

The creation of such a vortex in the drainage liquid may be exacerbated by the structure of the housing in respect of the shape of surfaces surrounding, and leading to, the drainage duct and the axle mount.

Patent specifications GB 2049494 and 2120134 describe a centrifugal separator in which the floor of a circularly cylindrical housing is in the form of a substantially conical funnel leading to a central, or axial, drainage duct. The centrifugal separation rotor comprises a canister mounted for rotation within the housing (from the side wall of which it is separated by only a small radial clearance) on an axle which is supported, with respect to the housing, raised above the floor by a cage or spider comprising an array of divergent legs separated circumferentially by drainage apertures for the liquid ejected from the rotor.

The above-mentioned GB 2049494 describes briefly the problem of liquid being driven up the side wall towards the rotor and suggests attachment of a small lip on the side wall of the housing as a barrier to this.

It has been found that such centrifugal separator design when used with modern engines and lubricants, which operate at higher temperatures and lower viscosities, and correspondingly increased throughput for similar pressures, results in a significantly increased tendency for the liquid leaving the rotor nozzles to accumulate within the housing contrary to what might be expected. The dynamics of such a vortex with liquids of various viscosities suggests that such a lip baffle would produce, for liquids and viscosities typical of that time, a temporary impedance over which the vortex would tend to creep, but for liquids of lower operating viscosities a greater effect in halting the climb of such a vortex, but this is not experienced in practice.

Viewed somewhat simplistically, a vortex of liquid with a higher viscosity tends to have a more uniform structure and surface on which the newly ejected liquid impinges and merges with uniform results, whereas such a vortex of liquid with a low viscosity is found to have local turbulence within the body of the vortex and out of its surface and a tendency for both the liquid of the vortex and liquid ejected from the rotor that is incident on the vortex to splash and froth in the proximity of the rotor to the extent that the presence per se of such vortex separately from its climbing to fill the gap between rotor canister and housing, is a source of impedance to canister rotation detracting from the separation efficiency.

Therefore it is considered that a simple baffle to impede climbing of a vortex is not appropriate.

It is an object of the present invention to provide a centrifugal separator, including a separation rotor that is supported above the housing floor by a cage, and vortex disruption means to prevent accumulation in the housing of liquid ejected from the rotor as a vortex, that is capable of operating more efficiently than hitherto.

According to the present invention a self-powered centrifugal separator comprises a housing defined by a cylindrical side wall and by a floor shaped to effect drainage of fluid from the housing into a drainage duct, a centrifugal separation rotor, supported with respect to the housing for rotation therein about a rotation axis, arranged to receive fluid at elevated pressure and eject it by way of substantially tangentially directed reaction nozzles into the housing, said rotor being supported spaced with respect to the floor of the housing by means of a cage having a central mounting region coupled to the rotor and a surrounding apertured drainage region extending to the housing, and vortex disruption means, operable to inhibit accumulation of ejected fluid within the housing, comprising at least one deflection vane extending over a part of the cage drainage region in the same direction as rotation of the rotor, said vane having a first edge extending substantially parallel to the housing side wall closer than the spacing between said side wall and separation rotor and inclined with respect to said rotation axis in the direction of rotor rotation, and having a second edge extending from the end of said first edge to the vicinity of the central mounting region.

An embodiment of the invention will now be described by way of example with reference to the accompanying drawings.

DETAILED DESCRIPTION OF THE INVENTION

Figure 1:
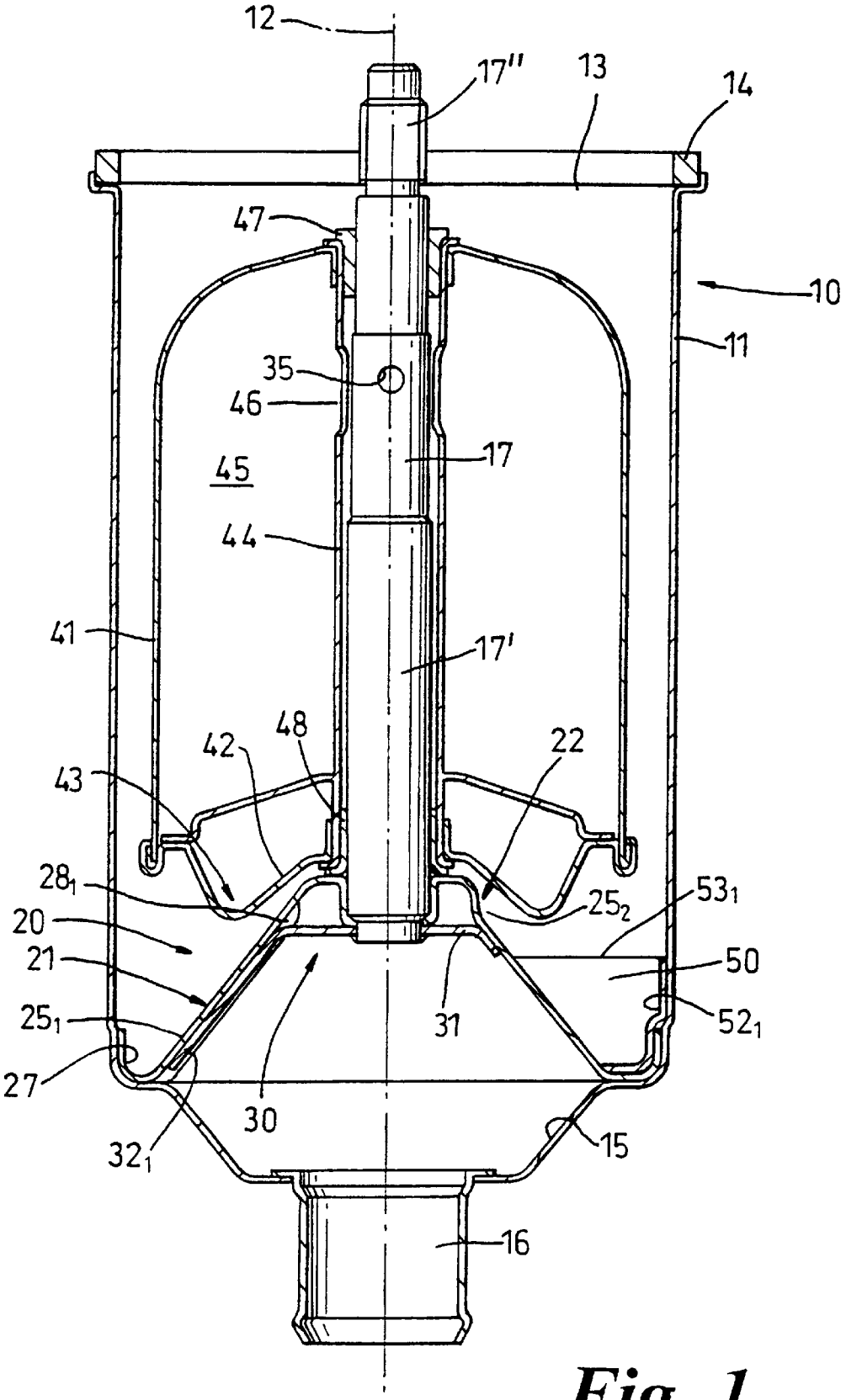
FIG. 1 is a sectional elevation through a centrifugal separator in accordance with the present invention.

Referring to FIG. 1, a centrifugal separator 10 for use in the lubrication system of a vehicle internal combustion engine comprises a housing 11 in the form of a right circular cylinder centred on a longitudinal axis 12 and open at one end 13. The housing is surrounded at end 13 by a sealing element 14 for mounting against a surface of the vehicle engine (not shown) which serves to close off the end of the housing and from which the housing operably depends.

The other end of the housing is formed as a floor 15 which tapers as a funnel to a coaxial drainage duct 16.

An axle 17 extends along the longitudinal axis 12 within the housing from a first axle or shaft end region 17', at which it is secured to a mount 20, to a second end region 17" having a threaded periphery by way of which the axle, and the separator as a whole, is removably secured to the vehicle engine.

Figure 2:
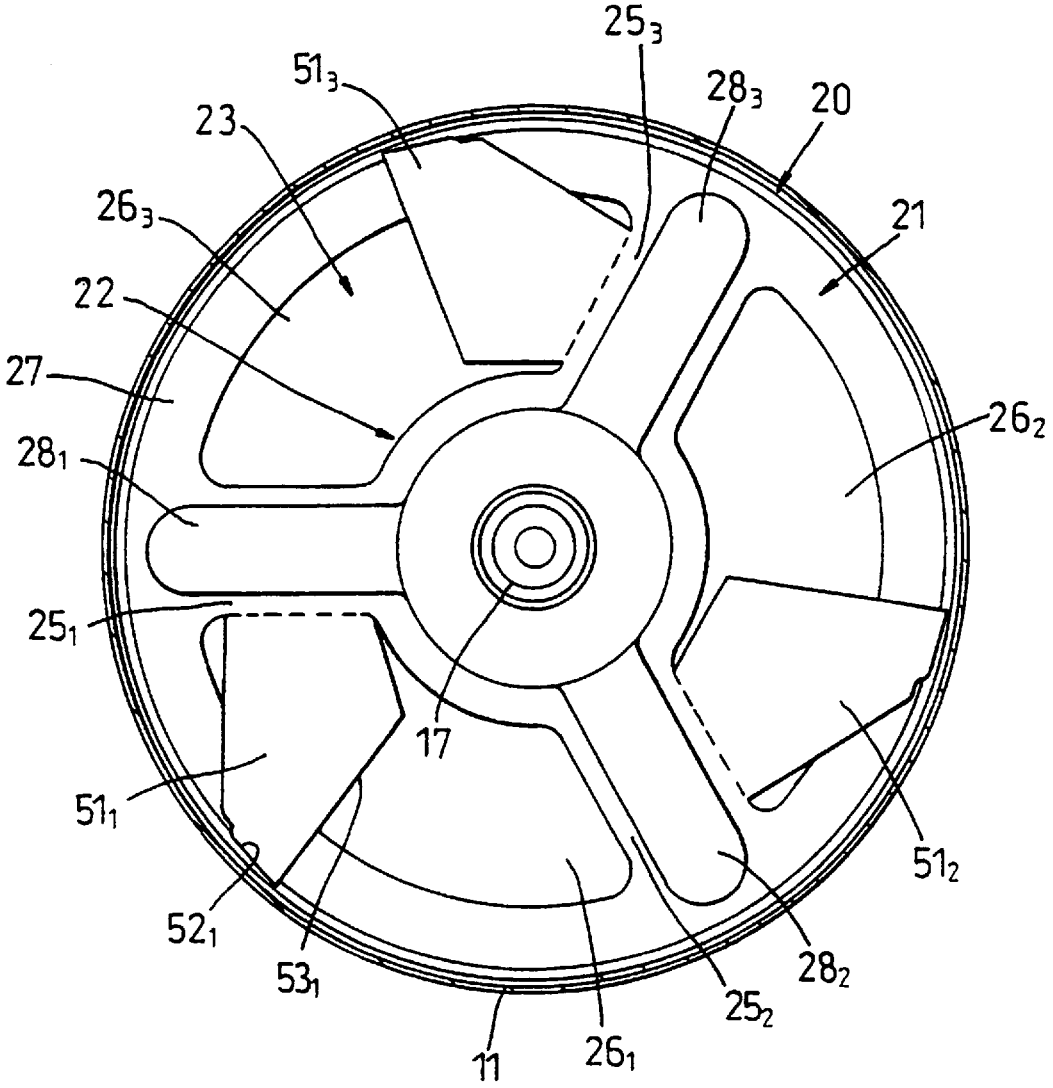
FIG. 2 is a top view of the separator of FIG. 1 with the rotor removed.

Referring also to FIG. 2, the mount 20 comprises a cage or spider 21 having a central mounting region 22, to which the axle end region 17' is secured spaced with respect to the floor 15, and a surrounding apertured drainage region, indicated at 23, extending radially and axially to the housing. The drainage region of the cage comprises an array of legs $\mathbf{25}_1$, $\mathbf{25}_2$, $\mathbf{25}_3$ diverging with respect to each other radially outwardly from the central mounting region and separated in a circumferential direction by drainage apertures $\mathbf{26}_1$, $\mathbf{26}_2$, $\mathbf{26}_3$, said legs at the ends thereof adjacent the housing being jointed by an annular rim 27 in contact with the housing wall continuously about the periphery. The annular rim is curled to conform to the corner of the housing between the side wall and floor to align the axes of the axle and housing, and is secured to the housing by welding or the like, whereby the housing is secured with respect to the vehicle by way of the axle 17. That is, the axle depends from the vehicle and the housing depends from the axle.

The cage is formed from a flat metal sheet by stamping out the drainage apertures $\mathbf{26}_1$ etc and then deforming it axially to provide said central mounting region, legs and annular rim integrally. The cage appears in elevation with the aperture drainage region as a truncated cone and the legs and drainage apertures defining a frusto conical plane within the housing. The legs $\mathbf{25}_1$, etc, of the cage are provided with strength to take axial mounting loads by means of pressed ribs or embossment $\mathbf{28}_1$, $\mathbf{28}_2$ $\mathbf{28}_3$.

To further increase the strength of the cage and axle support, a correspondingly legged bracing member 30, having a central region 31 and integral legs $\mathbf{32}_1$ etc, is disposed adjacent to the cage sheet with the legs overlying and joined to each other and the central mounting regions 22 and 31 spaced axially as a 'box section' into which the end region 17' of the axle is mounted.

The axle 17 contains a passage extending from the end 17" and opening by way of transverse aperture 35. Upon the axle 17 is supported a centrifugal separation rotor 40 in the form of an annular canister having an integral sidewall and top portion 41 and base portion 42 containing an array of jet reaction nozzles, only one of which is shown at 43. The portions 41 and 42 surround a tubular member 44 which extends for the length of the rotor and defines an annular enclosure 45 within the rotor, the tubular member 44 being apertured at 46 to receive liquid from the axle aperture 35 and further carrying at opposite ends thereof bearing bushes 47 and 48 by way of which the rotor is able to undertake high speed rotation about the axle.

The jet reaction nozzles 43 et al in the base of the rotor are directed substantially tangentially with respect to the longitudinal axis 12 and possibly slightly declined towards the floor of the housing, such arrangement being conventional to avoid, as far as is feasible, the liquid from the reaction jets which impinges against the wall of the housing from splashing against the rotor and disrupting its smooth rotation.

However, the circular cross section of the housing encourages the discharged liquid to circulate around the housing, low viscosity liquid tending on the one had to swirl more readily and rapidly but on the other hand more turbulently and presenting a rough surface, so that frothing and splashing of the vortex liquid itself and subsequently ejected liquid which is incident upon the liquid of the vortex is more likely to forth and splash and impinge detrimentally on the rotor canister. Thus at low liquid viscosities it is perceived as being the presence per se of a vortex of undrained liquid that is detrimental to rotation efficiency, irrespective of the effects of such vortex climbing the housing wall towards the rotor.

In accordance with the present invention vortex disruption means is provided, indicated generally at 50 comprising associated with each radially and axially extending leg of the cage a deflection vane $\mathbf{51}_1$, $\mathbf{51}_2$, $\mathbf{51}_3$ respectively which extends from the leg in the same direction as the rotation of the rotor and overlying a part of the cage drainage region $\mathbf{26}_1$, $\mathbf{26}_2$, $\mathbf{23}_3$ respectively.

Each vane, such as $\mathbf{51}_1$, is formed as an integral extension of a layer of the laminated leg, that is, formed by a sheet of metal, conveniently that of the leg member $25_1$. The vane extends in the same direction as rotation of the rotor, overlying the cage drainage region aperature $26_1$ that is, in a generally tangential direction in which it would intersect the side wall of the housing, but also is bent with respect to the edge of the leg in a direction towards the wall so that it intrudes into the region above the drainage region through which the reaction jets are ejected such that its lower surface serves to intercept such jets at appropriate rotational positions of the rotor. The ejected liquid which is incident upon such surface and relatively close to the nozzles from which it issues, is deflected in a generally downward direction towards the drainage aperature $26_1$; by such direction change a reaction boost may be imparted to the rotor in its direction of spin but most importantly the liquid is prevented from contributing to a circumferential vortex flow of such ejected liquid about the side wall and rim 27. However, other than when a reaction jet impinge directly upon the deflection vane, it impinges upon the housing side wall which deflects it circumferentially and by gravitational forces, impinge upon any liquid attempting to circulate as a vortex above rim 27. The deflection vane extends also to the vicinity of the side wall of the housing and any part of it effected by the annular rim 27. The vane $51_1$ has a first edge $52_1$ which extends substantially parallel to, the side wall being inclined to the longitudinal axis 12 in accordance with the deflection of the vane; it has a second edge $53_1$ which extends from the end of the first edge to the vicinity of the rotor mounting region. The deflection vane extends from the leg to the extent that the second edge extends (in plan view) in a substantially radial direction towards the housing wall.

The intersection between side wall and rim 27 is both cranked, in respect of the side wall locating the rim and the additional thickness of the rim, and curved by the curled form of the rim. Therefore it is convenient to cut the edge of the vane blank before bending so that it conforms closely to the shape locally. The first edge $52_1$, is conveniently straight, notwithstanding that it is intended to lie against a side wall curved in the circumferential direction, providing that any part of the edge is closer to the side wall than the separation between rotor canister and side wall. Preferably the first edge is arranged to contact the wall at one or both edges, but contact is not essential if the maximum spacing is not exceeded, permitting the vane to be set with assembly of the cage prior to disposal within the housing.

Whereas the vane does not require securing to the housing, insofar as the cage rim 27 is (or may be) secured by spot welding to the housing the first edge of the vane may also be secured directly to the housing. The above description relating to vane $25_1$, is of course applicable to the other vanes $25_2$ and $25_3$.

Each vane is conveniently a flat plane so that liquid ejected from the rotor canister in a tangential direction is deflected inwardly perpendicularly to the legs/drainage apertures whilst being a simple structure to manufacture, but if desired the vane may have a curvature along and/or across all or part of it to modify the redirection of the liquid or disruption of any vortex tending to form.

In the form illustrated, each vane overlies the respective drainage aperture, to an extent which does not interfere with the effective area as seen by liquid above it, by bending the vane upwardly towards the rotor and housing. It will be appreciated that if desired the vane may be less inclined, if at all, and extend further in a circumferential direction until intersection with the side wall, that is, tangentially.

It will be appreciated that although it is convenient to have a plurality of substantially identical deflection vanes extending one from each of the cage legs, they may differ in dimensions and/or inclination, absolutely and with respect to each other, and fewer vanes may be employed. For example, a single vane only may be employed, its presence serving to impede the formation of any rotational liquid and deflect it towards the floor.

It will be appreciated that each deflection vane may be formed integrally with either layer of such laminated leg structure or even formed non-integrally, being either secured to any such leg structure or, in the case of such laminated leg structure, being sandwiched between laminations. Any deflection vane may be formed of other than the above-mentioned sheet metal, provided it is compatible with the operating conditions encountered within the housing.

It will be appreciated that the axle mount cage may be formed substantially as described but omitting the bracing member, which structural form limits only the options available for mounting the deflection vanes.

It will be appreciated that such an axle mount cage may be formed with other than discrete identifiable legs separated by arcuate drainage apertures, for example, as a mesh or perforated sheet structure, but by appropriate construction one or more such deflection vanes may be employed attached to such mount or separately mounted within the housing between the mount and rotor.

The centrifugal separator structure described above has a fixed axle which supports and defines a rotation axis for the separation rotor canister. It will be appreciated that the present invention is applicable without change where the separation rotor is of the type that has an integral rotatable spindle which is mounted in place of the axle.

Similarly, the floor of the housing need not be of the funnel shape of the above-described embodiment, as such effects occur with substantially 'flat' floors where such rotational motion is permitted to build up in the ejected fluid.

What is claimed is:

1. A self-powered centrifugal separator comprising a housing defined by a cylindrical side wall and by a floor shaped to effect drainage of fluid from the housing into a drainage duct, a centrifugal separation rotor, supported with respect to the housing for rotation therein in a predetermined direction about a rotation axis, and arranged to receive fluid at elevated pressure, and to eject the fluid by way of substantially tangentially directed reaction nozzles into the housing, said rotor being supported spaced with respect to the floor of the housing by means of a cage having a central mounting region coupled to the rotor and a surrounding apertured drainage region extending to the housing, and vortex disruption means, operable to inhibit accumulation of ejected fluid within the housing, comprising at least one deflection vane overlying a part of said drainage region in said predetermined direction of rotation of the rotor, said vane having a first edge thereof extending substantially parallel to the cylindrical side wall closer than the spacing between said cylindrical side wall and separation rotor and inclined with respect to said rotation axis in said direction of rotor rotation, and having a second edge extending from an end of said first edge to a location proximate the central mounting region.

2. A centrifugal separator as claimed in claim 1 wherein said second edge of the vane is arranged to extend substantially radially with respect to the housing.

3. A centrifugal separator as claimed in claim 1 wherein at least one said vane is substantially planar.

4. A centrifugal separator as claimed in claim 1 wherein said first edge is straight and is arranged to touch the side wall at at least one end of said edge.

5. A centrifugal separator as claimed in claim 1 wherein the apertured drainage region of the cage comprises an array of legs extending substantially radially outwardly from the central mounting region to the housing and separated in a circumferential direction by drainage apertures.

6. A centrifugal separator as claimed in claim 5 wherein said legs at the end thereof adjacent the housing are joined by an annular rim in contact with the cylindrical wall continuously about the periphery.

7. A centrifugal separator as claimed in claim 6 wherein the rim is curved to conform to the junction between the cylindrical side wall and floor and the vane is shaped to conform with a curvature of the rim.

8. A centrifugal separator as claimed in claim 6 wherein at least one of said legs and annular rim are secured to the housing at the junction between the side wall and floor of the housing.

9. A centrifugal separator as claimed in claim 8 wherein said at least one deflection vane comprises a plurality of deflection vanes, and further wherein at least one of said legs has one of said plurality of deflection vanes extending integrally therefrom.

10. A centrifugal separator as claimed in claim 5 wherein said at least one deflection vane comprises a plurality of deflection vanes, and further wherein at least one of said legs has one of said plurality of deflection vanes extending integrally therefrom.

11. A centrifugal separator as claimed in claim 5 wherein the cage is formed of pressed sheet metal that includes the central mounting region integrally with the legs and a correspondingly legged bracing member disposed with the corresponding legs overlying and joined to each other, each deflection vane of the vortex disruption means being formed integrally with a leg of the bracing member.

12. A centrifugal separator as claimed in claim 11 wherein the bracing member does not extend radially to the housing.

13. A centrifugal separator as claimed in claim 5 wherein the cage is formed of pressed sheet metal that includes the central mounting region integrally with the legs and a correspondingly legged bracing member disposed with the corresponding legs overlying and joined to each other, each deflection vane of the vortex disruption means being secured with respect to the legs of the cage by sandwiching between said cage and bracing member.

14. A centrifugal separator as claimed in claim 13 wherein the bracing member does not extend radially to the housing.

* * * * *